US011369997B2

(12) United States Patent
Juutinen et al.

(10) Patent No.: US 11,369,997 B2
(45) Date of Patent: Jun. 28, 2022

(54) SCREENING DEVICE

(71) Applicant: Metso Minerals, Inc., Tampere (FI)

(72) Inventors: Tuomas Juutinen, Tampere (FI); Jouni T. Rajala, Pirkkala (FI)

(73) Assignee: Metso Minerals, Inc., Tampere (FI)

( * ) Notice: Subject to any disclaimer, the term of this patent is extended or adjusted under 35 U.S.C. 154(b) by 0 days.

(21) Appl. No.: 17/252,077

(22) PCT Filed: Jun. 13, 2019

(86) PCT No.: PCT/EP2019/065525

§ 371 (c)(1),
(2) Date: Dec. 14, 2020

(87) PCT Pub. No.: WO2019/238833

PCT Pub. Date: Dec. 19, 2019

(65) Prior Publication Data

US 2021/0252555 A1 Aug. 19, 2021

(30) Foreign Application Priority Data

Jun. 14, 2018 (EP) ..... 8177869

(51) Int. Cl.
*B07B 1/00* (2006.01)
*B07B 1/49* (2006.01)

(52) U.S. Cl.
CPC ..... *B07B 1/005* (2013.01); *B07B 1/49* (2013.01); *B07B 2201/04* (2013.01)

(58) Field of Classification Search
CPC ..... B07B 2201/04; B07B 1/00; B07B 1/005
(Continued)

(56) References Cited

U.S. PATENT DOCUMENTS 3,608,720 A * 9/1971 Symons ..... B07B 1/48 209/405
4,732,670 A * 3/1988 Nelson ..... B07B 1/48 209/403
4,906,352 A * 3/1990 Nelson ..... B07B 1/48 209/403

FOREIGN PATENT DOCUMENTS

WO 94/26427 A1 11/1994

OTHER PUBLICATIONS

International Search Report and Written Opinion for International Patent Application No. PCT/EP2019/065525 dated Sep. 9, 2019.
(Continued)

*Primary Examiner* — Terrell H Matthews
(74) *Attorney, Agent, or Firm* — Andrus Intellectual Property Law, LLP

(57) ABSTRACT

A screening arrangement including two side walls, each having an inward facing side and an outward facing side, and a screen holder arrangement extending between the inward facing sides of the side walls for use in connecting a first and a second screening element. The screen holder arrangement includes a first screen connector and a second screen connector. The first screen connector includes a pivotable element arranged to pivot about an axis that is parallel with a longitudinal extension of the first screen connector. The pivotable element includes a connection portion arranged to hold one end of the first screening element. The pivotable element is arranged to pivot between a first position and a second position, where the pivotable element is arranged such that when it is in the second position and a screen is connected to the pivotable element, particles larger than a predetermined size are prevented from passing between the first and second screen connectors.

15 Claims, 5 Drawing Sheets

(58) Field of Classification Search
USPC ..... 209/363
See application file for complete search history.

(56) References Cited

OTHER PUBLICATIONS

International Preliminary Report on Patentability for International Patent Application No. PCT/EP2019/065525 dated Oct. 12, 2020.

* cited by examiner

SCREENING DEVICE

CROSS-REFERENCE TO RELATED APPLICATIONS

This application is the U.S. national stage application of International Application PCT/EP2019/065525, filed Jun. 13, 2019, which international application was published on Dec. 19, 2019, as International Publication WO 2019/238833 A1 in the English language. The International Application claims priority of European Patent Application No. 18177869.7 filed Jun. 14, 2018.

FIELD OF THE INVENTION

The present invention relates to a screen holder arrangement, a screening arrangement and a screening device for use in material screening in a mobile crushing and screening plant.

BACKGROUND

Commonly available screening arrangement often comprises a plurality of sequentially arranged screening elements for categorizing a material stream into different size categories. The screening elements may either be tensioned longitudinally or transversally, as measured along a transportation direction of the screening arrangement. For longitudinally tensioned screening elements, each one of the screening elements often comprises tensioning means arranged at one end, and a fixed connection point arranged at the other end of the screening element. In commonly available screening arrangements, the tensioning elements are located on the outside of the screening arrangement, and the fixed connection points for the screening elements are arranged in a middle region of the screening arrangement. Thus, there is a need for a centrally arranged connection point for screening elements that allows for easy connection of a screening element thereto.

Examples of such connection points for screening elements may for example be a fixed beam comprising two ridges, to each one of which a respective screening element may be connected. However, connecting two screening elements to a single fixed beam involves significant effort from the user, as the stiffness of the screening elements needs to be overcome in order for the screening elements to be connected to the fixed beam.

In response to this, several movable connection points for screening elements to be connected to have been provided. However, these solutions often involve significant leakage of material between two adjacent screening elements. Thus, there is a need to provide a screening arrangement to which two screens may easily be connected without running the risk of material spillage between the two screens.

SUMMARY OF THE INVENTION

An object of the present invention is therefore to alleviate the abovementioned problems and provide a screening arrangement that allows convenient connection of two screens such that there is little risk for spillage of material between the two screens.

The above and other objects which will be evident from the following description are achieved by a screening arrangement according to the first aspect of the present invention, by a screening device according to the second aspect of the present invention, and/or by a method according to the third aspect of the present invention.

According to the first aspect of the present invention, a screening arrangement is provided. Said screening arrangement comprises two side walls, each having an inward facing side and an outward facing side, and a screen holder arrangement extending between said inward facing sides of said two side walls for use in connecting a first and a second screening element, said screen holder arrangement comprising:

a first screen connector and a second screen connector, wherein said first screen connector comprises a pivotable element arranged to pivot about an axis that is parallel with a longitudinal extension of said first screen connector, wherein said pivotable element comprises a connection portion arranged to hold one end of said first screening element, and said pivotable element is arranged to pivot between a first position and a second position, respectively.

According to one exemplary embodiment if the first aspect of the present invention, said pivotable element is arranged such that when it is in said second position and a screen is connected to said pivotable element, particles larger than a predetermined size are prevented from passing between said first and second screen connectors.

Thus, particles that are not intended to pass through a screening element which may be connected to the pivotable element may not pass between the first and second screen connectors either. In other words, unintended spillage of large size particles through a space between the first and second screen connectors is avoided when the pivotable element is in said second position and a screen is connected to said pivotable element.

According to one exemplary embodiment of the first aspect of the present invention, a seal is formed between said first and second screen connectors when said pivotable element is in said second position and a screen is connected to said pivotable element.

A seal is to be understood as being a space through which the passage of particles is impeded, either by a decreased distance between the first and second screen connectors or a complete obstruction of the space between the two screen connectors, e.g. by said pivotable element being arranged to pivot such that when said pivotable element is in said second position and said first screening element is connected thereto, a portion of said first screening element abuts a portion of said second screen connector.

A screening arrangement could for example be a part of a screening device comprising a material inlet, and said screening device being arranged to hold a plurality of screening elements and/or cause said screening elements to vibrate. This allows a material feed to be transported thereon, and screened so as to separate the material feed into different size categories. Thus, the screening arrangement may be used to categorize a material feed into different size categories.

The two side walls may be understood as being two parallel and substantially vertical walls arranged at a distance from each other, said distance corresponding to the width of the screening elements arranged to be used with said screening arrangement. Inward facing side is to be understood as being the side of said respective wall that faces the other wall. In other words, the inward facing side of a wall faces a space in which the screening elements and the screen holder arrangement may be provided. Conversely, the outward facing side is the opposite side to the inward facing side.

The two side walls of the screening arrangement serve a dual purpose. For one, they act as connection points for the first and the second screen connector. This enables a reliable connection of the screen connectors to the screening arrangement. Also, the side walls function as means for preventing the material fed onto screening elements connected to the screen holder arrangement from sliding off either side of the screening elements. This is to be understood as meaning that the side walls may be arranged to prevent material from falling off the lateral sides of the screening elements connected to the screen connectors, said lateral sides being the two side that extends in a longitudinal and/or transporting direction of the screening elements.

A screening element is to be understood as being an element used in screening particles of one size from particles of a larger size. A screening element may be understood as meaning for example a mesh screen or other screens used in vibrating screen arrangements. For example, said screening element could be a rectangular mesh having a plurality of openings of a predetermined screening size evenly distributed over its surface. The screening element may have two lateral sides, and two end sides. The lateral sides are the longer sides extending between the two shorter end sides. The end sides are the sides of the screening element that are used in connecting the screening element to e.g. a screen connector.

It should be understood that said first screen connector is arranged to allow said first screening element to be connected thereto. Conversely, said second screen connector is to be understood as being arranged to allow said second screening element to be connected thereto.

A screen connector should be understood being arranged to allow a screening element to be connected to the screen holder arrangement, and thus to the screening arrangement. For example, the screen connector may be a fixed beam having a protrusion acting as a connecting portion for a screening element to be connected thereto. Additionally or alternatively, the screen connector may comprise a movable element to which the screening element may be connected. Such a movable element may for example be the pivotable element of the first aspect of the present invention.

Said connection portion of said pivotable element may be understood as being a portion of said pivotable element arranged to receive and hold a portion of a screening element. For example, said connection portion may be a ledge or ridge arranged to receive and hold a hook-shaped end portion of a screening element. However, other configurations of said connection portion of said pivotable element are also possible.

According to one exemplary embodiment of the first aspect of the present invention, said pivotable element, when in said second position, is arranged to pivot such that if said first screening element is connected thereto, a longitudinally extending seal between said first screen connector and said second screen connector is formed.

According to one exemplary embodiment of the first aspect of the present invention, said pivotable element is arranged to pivot such that when said pivotable element is in said second position and said first screening element is connected thereto, at least a portion of said first screening element abuts said second screen connector.

According to one exemplary embodiment of the first aspect of the present invention, said second screen connector is arranged to prevent said pivotable element from pivoting in a locking direction when said pivoting element is in a second position and said first screening element is connected thereto.

According to one exemplary embodiment of the first aspect of the present invention, said pivotable element is arranged such that when said screen holder arrangement is in use and said pivotable element is in said second position, said pivotable element is prevented from pivoting in said locking direction by interference between said pivotable element and said second screen connector.

Interference between said pivotable element and said second screen connector is to be understood as meaning that said pivotable element is prevented from moving in a locking direction due to the fact that at least a portion said pivotable element abuts at least a portion of said second screen connector. Said pivotable element may abut said second screen connector either directly, or indirectly. Indirect abutment is to be understood as meaning that an intermediate component is provided between said pivotable element and said second screen connector. For example, such an intermediate component may be an end portion of said first screening element.

According to one exemplary embodiment of the first aspect of the present invention, said first screen connector and said second screen connector are integrally formed. This may be understood as meaning that the first and second screen connectors may be rigidly connected to each other and/or made from one piece.

According to one exemplary embodiment of the first aspect of the present invention, said first screen connector is a first connector portion of said screen holder arrangement and said second screen connector is a second connector portion of said screen holder arrangement.

According to one exemplary embodiment of the first aspect of the present invention, said first screen connector and said second screen connector may be separate from each other. For example, said first screen connector may be a first beam extending between said two side walls, and said second screen connector may be a second beam extending between said two side walls, said second beam being arranged adjacent to said first beam. Thus, a pivotable element of said first screen connector may pivot such that a seal is formed between the first and the second screen connectors.

According to one exemplary embodiment of the first aspect of the present invention, said seal is formed by means of connection between said first screen connector, said second screen connector, and a portion of said first screening element.

Said seal being formed by means of connection between said first screen connector, said second screen connector, and a portion of said first screening element is to be understood as meaning that each one of these three components is in contact with at least one of the remaining two of these three components. For example, said seal could be formed by said first screen connector being in contact with said first screening element, said first screening element being in contact with said first screen connector and with said second screen connector, and said second screen connector being in contact with said first screening element. Thus, a space between said first screen connector and said second screen connector may be sealed when a portion of said first screening element is brought into contact with said first and second screen connectors by means of said pivotable element being moved from said first position to said second position. This enables secure connection of said screening element to said screening arrangement in a way such that spillage of material through a space between the first and second screen connectors is minimized.

According to one exemplary embodiment of the first aspect of the present invention, said seal is formed between said first and second screen connectors when said pivotable element is in said second position and a screen is connected to said connection portion of said pivotable element.

According to one exemplary embodiment of the first aspect of the present invention, said first screen connector further comprises an actuator connected to said pivotable element, wherein said actuator is arranged to control the pivot of said pivotable element.

According to one exemplary embodiment, the actuator is or comprises a removable handle, a fixed handle, a hexagonal nut on one end of the pivotable element, a hydraulic or pneumatic cylinder, or another movable mechanism.

According to one exemplary embodiment of the first aspect of the present invention, said actuator is arranged on or adjacent to said outward facing surface of one of said two side walls. This enables a user to actuate the pivotable element from an outside of said screening arrangement.

According to one exemplary embodiment of the first aspect of the present invention, said actuator comprises a handle arranged on said outward facing side of one of said two side walls, said handle being connected, through said side wall, to said pivotable element.

According to one exemplary embodiment of the first aspect of the present invention, said actuator further comprises a connection joint connecting said handle to said pivotable element.

According to one exemplary embodiment of the first aspect of the present invention, said actuator comprises a bearing element connected to said side wall and said connecting joint, said bearing element being arranged to support a rotational movement of said connecting joint.

According to one exemplary embodiment of the first aspect of the present invention, said actuator further comprises a sealing element for sealing said inwards facing side of said side wall from said outwards facing side of said side wall.

According to one exemplary embodiment of the first aspect of the present invention, said sealing element is an annular seal. According to one exemplary embodiment of the first aspect of the present invention, said sealing element and said bearing element may be integrally formed. Thus, the pivotable element may be actuated from outside said screening arrangement, without risking material spillage through the through-hole on said side wall through which said actuator extends.

According to one exemplary embodiment of the first aspect of the present invention, said pivotable element is arranged to pivot in an opening direction and a locking direction, between said first position and said second position, respectively.

The locking direction is to be understood as being the rotational direction of the pivotable element that causes the connection portion of the pivotable element to move towards the second screen connector, and thus towards the second position. The opening direction is to be understood as being the opposite rotational direction to the locking direction, thus causing the pivotable element to move towards the first position.

According to one exemplary embodiment of the first aspect of the present invention, said pivotable element is arranged such that when in said second position and with said first screening element connected thereto, said pivotable element is biased against pivoting in said opening direction by tension from said first screening element.

According to one exemplary embodiment of the first aspect of the present invention, said screening arrangement further comprises tensioning means, to which said first and second screening elements may be connected. The tensioning means may comprise a first tensioning element and/or a second tensioning element, arranged to allow said first and said second screening elements to be connected thereto, respectively.

According to one exemplary embodiment of the first aspect of the present invention, said screen holder arrangement is arranged in a middle portion of said screening arrangement, and said first tensioning element is arranged at a first end of said screening arrangement. According to one exemplary embodiment of the present invention, said screen holder arrangement is arranged in a middle portion of said screening arrangement, and said second tensioning element is arranged at a second end of said screening arrangement. A first end is to be understood as meaning an end portion of the screening arrangement, as measured along a longitudinal and/or transport direction of the screening arrangement. Said first end may additionally or alternatively be understood as being an output side or output end of said screening arrangement. Conversely, said second end may additionally or alternatively be understood as being an input side or input end of said screening arrangement. Said middle portion should be understood as being a portion of the screening arrangement that is located between the first end and the second end of the screening arrangement.

This is to be understood as meaning that when said first screening element is connected to said screening arrangement and said pivotable element is in said second position, tension from said first screening element biases said pivotable element in a locking direction. Said tension may for example be due to the first screening element being tensioned by means of said first tensioning element. Thus, said seal between said first and second screen connectors is strengthened and/or reinforced by said first screening element biasing said pivotable element towards said second position.

According to one exemplary embodiment of the first aspect of the present invention, said second screen connector comprise a fixed beam having a connection portion arranged to hold one end of said second screening element.

According to one exemplary embodiment of the first aspect of the present invention, said second screen connector is arranged to allow said second screening element to connect to an upper portion of said fixed beam, wherein said seal is formed between said first screen connector and a lower portion of said second screen connector. Thus, said seal between said first and second screen connectors is independent on whether or not there is a connection of said second screening element to said second screen connector. According to one exemplary embodiment of the first aspect of the present invention, said seal is formed between said pivotable element of said first screen connector, said lower portion of said second screen connector, and a portion of said first screening element.

According to one exemplary embodiment of the first aspect of the present invention, each one of said two side walls comprises a respective first guiding ledge for guiding said first screening element towards said connection portion of said pivotable element.

According to one exemplary embodiment of the first aspect of the present invention, said first guiding ledges extend perpendicularly from said respective side wall.

According to one exemplary embodiment of the first aspect of the present invention, said first guiding ledges are arranged to provide a seal between said side walls and said first screening element. Thus, the risk for material spillage on the sides of the first screening element is reduced. Additionally, said first guiding ledges help a user of said screening arrangement in connecting said first screening element thereto.

According to one exemplary embodiment of the first aspect of the present invention, said first guiding ledge of at least one side wall extends above a portion of said side wall through which said handle is connected to said pivotable element.

That one of said first guiding ledges extends above said portion of said side wall is to be understood as meaning that said first guiding ledge is arranged to cover or shield the through-hole through which said actuator extends. It may be understood that said first guiding ledge provides a roofing for said through-hole. Thus, the risk of material spillage through said through-hole is reduced.

According to one exemplary embodiment of the first aspect of the present invention, each one of said two side walls comprises a second guiding ledge for guiding said second screening element towards a connection portion of said second screen connector.

According to one exemplary embodiment of the first aspect of the present invention, said second guiding ledge of each one of said two side walls extend perpendicularly from said respective side wall.

According to one exemplary embodiment of the first aspect of the present invention, said second guiding ledges are arranged to provide a seal between said side walls and said second screening element. Thus, the risk for material spillage on the sides of the second screening element is reduced. Additionally, said second guiding ledges help a user of said screening arrangement in connecting said second screening element thereto.

According to one exemplary embodiment of the first aspect of the present invention, said first and second guiding ledges form a seal between said side walls and said first and second screening elements, respectively.

According to a second aspect of the present invention, a screening device is provided. Said screening device comprises a screening arrangement according to any exemplary embodiment of the first aspect of the present invention, and a first and a second screening element connected thereto.

Any aspects or features of any exemplary embodiments of the first aspect of the present invention are applicable to this second aspect of the present invention as well.

According to a third aspect of the present invention, a method for connecting a screening element to a screening arrangement is provided. Said method comprises the steps of:

providing a screening arrangement according to any exemplary embodiment of the first aspect of the present invention, providing a first screening element and a second screening element, said first and second screening elements each having a connection portion located at one end of said respective screening element, moving said pivotable element to said first position, inserting said first screening element into a position such that said connection portion of said first screening element is moved past said pivoting element, moving said pivotable element to said second position, withdrawing said first screening element such that said connection portion of said first screening element comes into contact with said connection portion of said pivotable element, thus connecting said first screening element to said first screen connector, connecting said connection portion of said second screening element to said second screen connector.

Any aspects of any exemplary embodiments of the first aspect of the present invention are applicable to this third aspect of the present invention as well, mutatis mutandis.

By providing such a method, an easy and convenient way to connect and secure screening elements to a screening arrangement is provided.

By moving said pivotable element into said first position before inserting said first screening element into said screening arrangement, a more convenient and reliable insertion of said first screening element is enabled. This is due to the fact that the pivotable element, to which said first screening element is to be connected, is moved out of the path of insertion of the first screening element as it is inserted into the screening arrangement.

By connecting the first screening element to the pivotable element and moving the pivotable element to the second position, a seal between the first and second screen connectors is achieved. Thus, it is possible to connect the first screening element to the first screen connector while simultaneously providing a seal between the first and second screen connector. This allows for a convenient and reliable connection and a lowered risk for material spillage between the two screen connectors.

According to one exemplary embodiment of the third aspect of the present invention, said method further comprises the step of connecting said first screening element to said first tensioning element and tensioning said first screening element by means of said first tensioning element.

According to one exemplary embodiment of the third aspect of the present invention, said method further comprises the step of connecting said second screening element to said second tensioning element and tensioning said first screening element by means of said second tensioning element.

According to a fourth aspect of the present invention, a mobile material processing plant is provided, comprising a screening arrangement according to any one of claims 1-12.

According to one exemplary embodiment of the fourth aspect of the present invention, the mobile material processing plant further comprises a first and a second screening element connected to the screening arrangement.

BRIEF DESCRIPTION OF THE DRAWINGS

The above, as well as additional objects, features and advantages of the present invention, will be better understood through the following illustrative and non-limiting detailed description of exemplary embodiments of the present invention, with reference to the appended drawing, wherein.

DETAILED DESCRIPTION OF THE DRAWINGS

In the present detailed description, embodiments of a screening arrangement according to the present invention are mainly discussed with reference to drawings showing a screening arrangement and/or a screening device with components and portions being relevant in relation to various embodiments of the invention. It should be noted that this by no means limits the scope of the invention, which is also applicable in other circumstances for instance with other types or variants of screening arrangements or screening devices than the embodiments shown in the appended drawings. Further, that specific features are mentioned in connection to an embodiment of the invention does not mean that those components cannot be used to an advantage together with other embodiments of the invention.

The invention will now by way of example be described in more detail by means of embodiments and with reference to the accompanying drawings.

Figure 1:
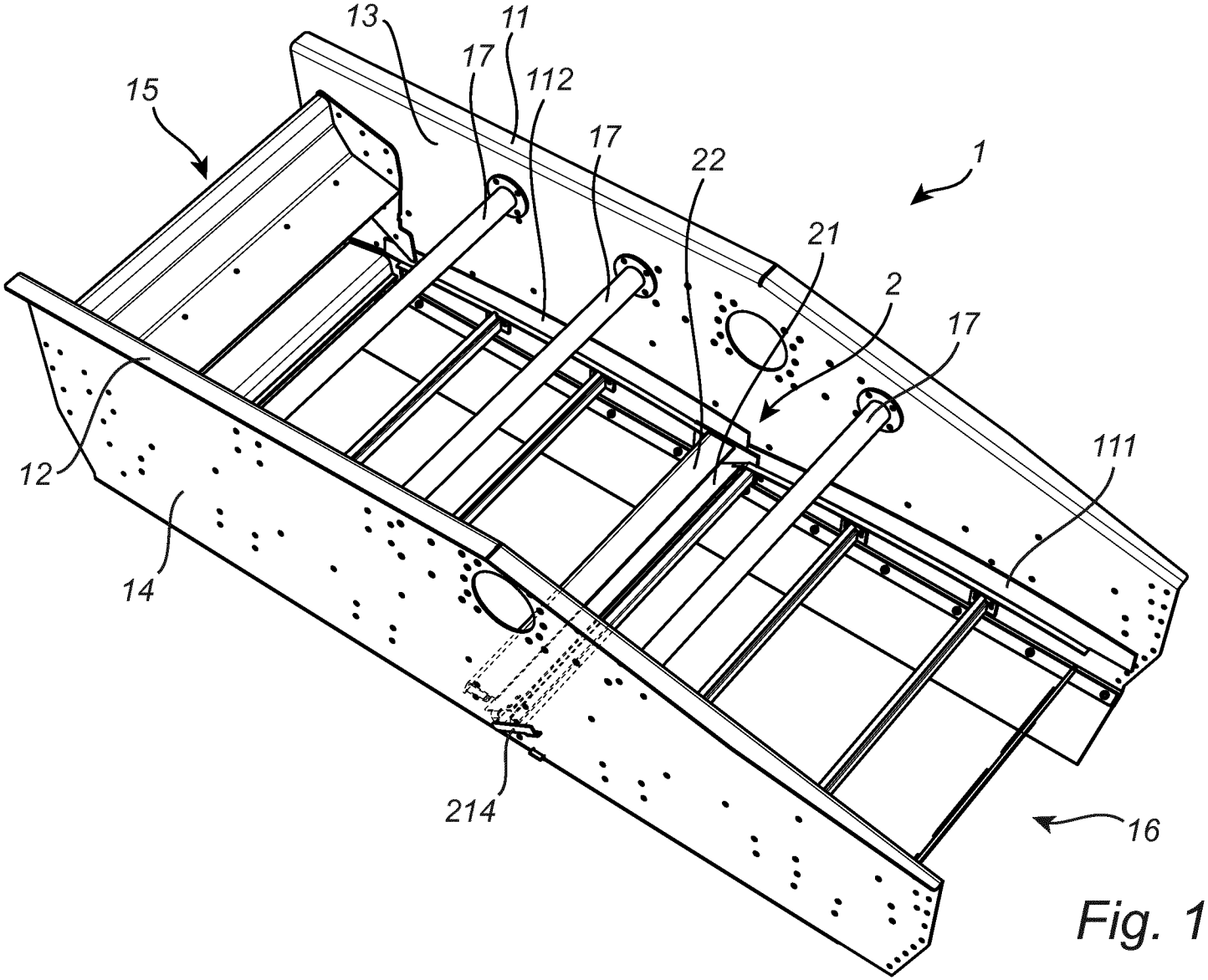
FIG. 1 is a perspective view of a screening arrangement according to one exemplary embodiment of the present invention.

FIG. 1 is a perspective view of a screening arrangement 1 according to one exemplary embodiment of the present invention. The screening arrangement 1 comprises two side walls 11, 12, each having an inward facing side 13 and an outward facing side 14. The screening arrangement 1 further comprises an inlet portion 15 for receiving a stream of material to be screened and an outlet portion 16 for discharging the material stream after it has passed the screening arrangement 1, wherein the inlet and the outlet portions 15, 16 are arranged at either end of the screening arrangement 1.

These two side walls 11, 12 are connected to each other by means of a plurality of supporting beams 17 extending between the two side walls 11, 12 in a perpendicular direction thereto. The supporting beams 17 help keep the screening arrangement 1 stable when screening elements 91, 92 connected thereto vibrate.

The screening arrangement 1 further comprises a screen holder arrangement 2 extending between said inward facing sides 13 of said two side walls 11, 12 for use in connecting a first and a second screening element 91, 92 thereto. The screen holder arrangement 2 is arranged between the inlet portion 15 and the outlet portion 16 of the screening arrangement 1. The screen holder arrangement 2 is arranged substantially equidistant from the outlet portion 16 and from the inlet portion 15 of the screening arrangement 1. This is due to the fact that the screening arrangement 1 is configured to be used together with two screening elements 91, 92 having substantially identical outer measurements. However, in other embodiments, the distance between the screen holder arrangement 2 and the inlet portion 15 may be greater, or smaller, than the distance between the screen holder arrangement 2 and the outlet portion 16 of the screening arrangement 1. Thus, different outer measurements may be used for the first screening element 91 and the second screening element 92.

The screen holder arrangement 2 comprises a first screen connector 21 and a second screen connector 22. The first screen connector 21 is arranged below the second screen connector 22. The first screen connector 21 is arranged to allow one end of a first screening element 91 to be connected thereto, and the other end to a first tensioning element arranged adjacent to the outlet portion 16 of the screening arrangement 1. The second screen connector 22 is arranged to allow a second screening element 92 to be connected thereto, and to a second tensioning element arranged adjacent to the inlet portion 15 of the screening arrangement 1. The first and second tensioning elements can be tensioning elements readily available to the person skilled in the field of material screening. Thus, the specific configuration of these will not be described in further detail herein. The first and second screen connectors 21, 22 will be described in greater detail in relation to FIGS. 3*a-d*.

Each one of the two side walls 11, 12 comprises a first guiding ledge 111 for guiding the first screening element 91 towards the first screen connector 21 of the screen holder arrangement 2.

The first guiding ledges 111 extend perpendicularly from the inward facing sides 13 of the two side walls 11, 12, such that a ridge or sliding track is provided for the first screening element 91 to slide on upon insertion into the screening arrangement 1. This allows a screening element 91 to be inserted into the screening arrangement 1 by a single user, without requiring a second user's assistance in handling the screening element 91 as it is inserted into the screening arrangement 1.

The first guiding ledges 111 extend a distance from the inward facing side 13 of the side walls 11, 12 such that they provide a seal between the side walls 11, 12 and the first screening element 91 when this has been inserted into the screening arrangement 1. This seal is formed by the lateral sides of the first screening element 91, i.e. the sides extending between the outlet portion 16 of the screening arrangement 1 and the screen holder arrangement 2, being covered by the first guiding ledges 111. Thus, material otherwise risking falling off the sides of the screening element 91 are prevented from doing so by the first guiding ledges 111, as these cover a space between the first screening element 91 and the inward facing sides 13 of the side walls 11, 12.

Furthermore, each one of said two side walls 11, 12 comprises a second guiding ledge 112 for guiding said second screening element 92 towards the second screen connector 22. The second guiding ledge 112 is arranged to form a seal between the second screening element 92 and the inward facing sides 13 of the two side walls 11, 12. The second guiding ledge 112 share most features with the first guiding ledge 111, and will therefore not be discussed in greater detail herein.

Figure 2:
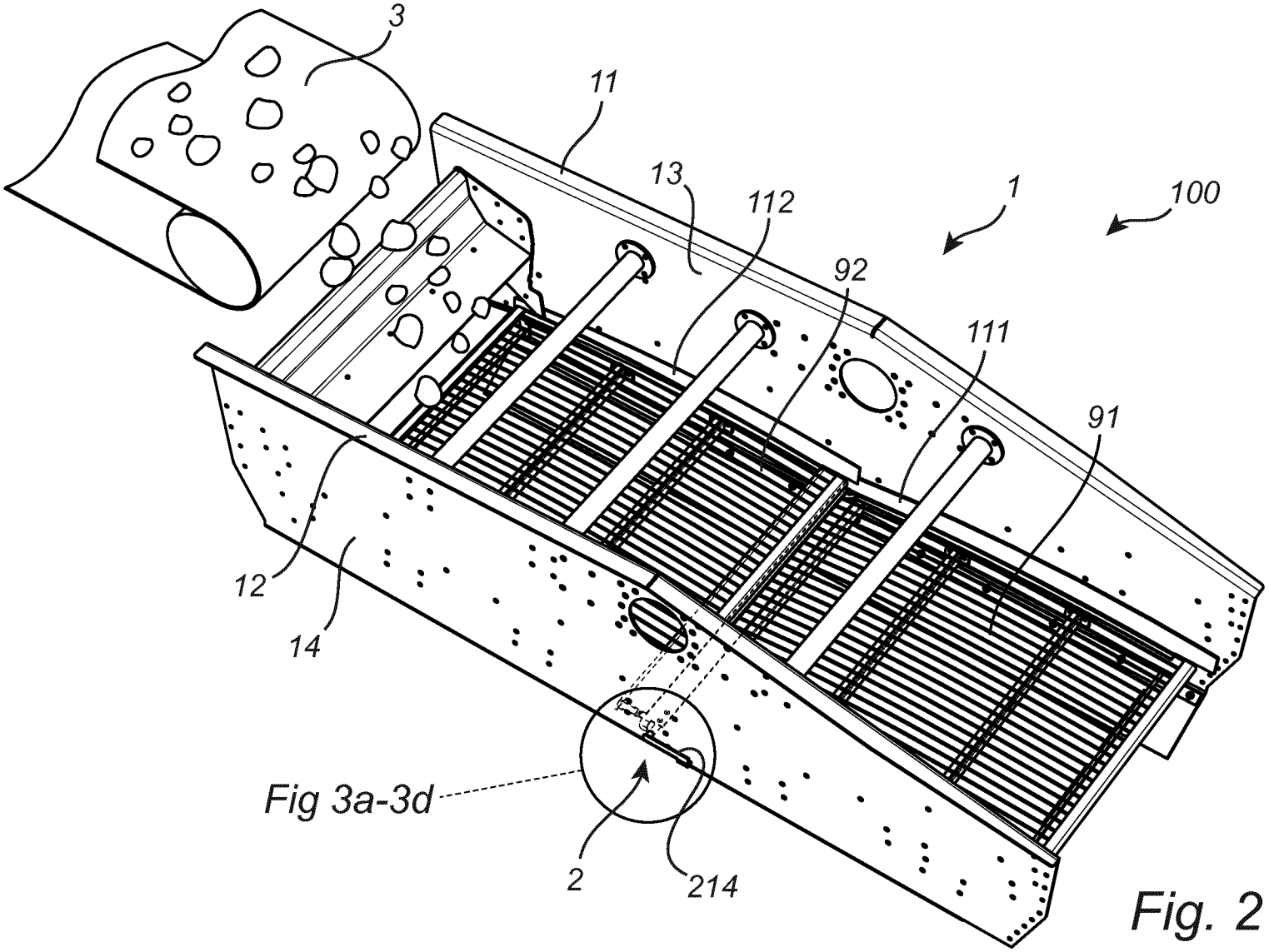
FIG. 2 is a perspective view of the screening arrangement of FIG. 1, wherein a first and a second screening element have been connected thereto.

FIG. 2 is a perspective view of the screening arrangement 1 of FIG. 1, wherein a first and a second screening element 91, 92, have been connected thereto.

What is shown in FIG. 2 could additionally or alternatively be referred to as a screening device 100 comprising a screening arrangement 1, and a first and a second screening element 91, 92 connected thereto. Also illustrated herein is a schematic representation of a material infeed, illustrated as a conveyor belt 3 having a discharge end located at a position above said input end 15 of said screening arrangement 1. Thus, material discharged from the conveyor belt 3 falls down on said second screening element 92 so that it may be screened by the screening device 100.

Figure 3A:
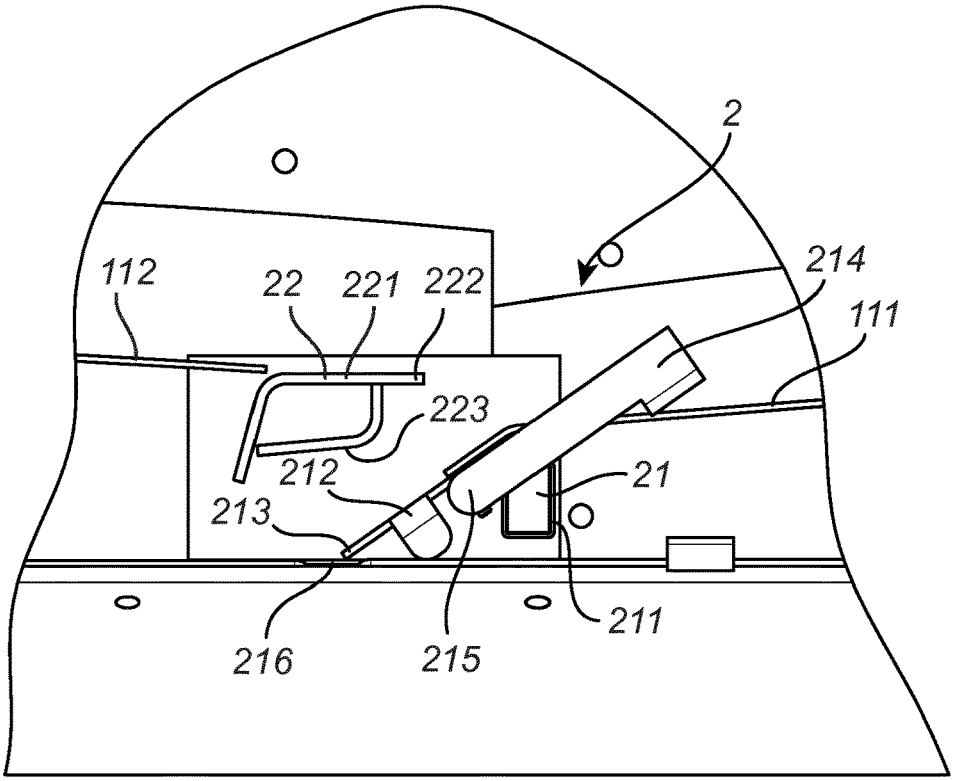
FIG. 3A is a side view of the screen holder arrangement according to one exemplary embodiment of the present invention, wherein the pivotable element of the first screen connector is in the first position.

FIG. 3A is a side view of the screen holder arrangement 2 according to one exemplary embodiment of the present invention. Shown herein is the first screen connector 21, which comprises a fixed element 211 extending between the inward facing sides 13 of the two side walls 11, 12, and a pivotable element 212 also extending between the inward facing sides 13 of the two side walls 11, 12. The pivotable element 212 is arranged such that it may pivot about an axis that is substantially perpendicular with the two side walls 11, 12, between a first position which allows a first screening element 91 to be inserted into the screening arrangement 1, and a second position which locks the first screening element 91 into connection with the first screen connector 21. In FIG. 3A, the pivotable element 212 is in the first position and the first screening element 91 has not been inserted into the screening arrangement 1.

The pivotable element 212 comprises a connection portion 213 arranged to allow a first screening element 91 to be connected thereto. The connection portion 213 is an edge extending between said two side walls 11, 12, the edge being arranged to allow for example a hook-shaped end portion 911 of the first screening element 91 to be connected thereto.

The first screen connector 21 further comprises an actuator, in FIG. 3A illustrated as a handle 214, connected to the pivotable element 212. The handle is arranged to control the pivot of the pivotable element 212, such that a user may move the pivotable element 212 between a first position and a second position. The handle 214 is arranged on the outward facing side 14 of one of the two side walls 11, 12, and connected to the pivotable element 212 by means of a connection joint 215 extending through the side wall 11, 12. The connection joint 215 is a rigid rod configured to translate a rotational movement or pivot of the handle 214 into a pivot of the pivotable element 212, such that a user may actuate the pivotable element 212 from outside the screening arrangement 1.

As is shown in FIGS. 3A-D, the pivotable element 212 is arranged to pivot in an opening direction and a locking direction, between the first position and the second position, respectively. In FIG. 3A, the pivotable element 212 is in the first position and further movement in the opening direction is prevented by the pivotable element 212 abutting a blocking ledge 216 arranged in the pivot path of the pivotable element 212.

The screen holder arrangement 2 shown in FIG. 3A also comprises a second screen connector 22. The second screen connector 22 is arranged to allow a second screening element 92 to be connected thereto, and comprises a fixed beam 221 having a connection portion 222 arranged to hold one end of said second screening element 92. The connecting portion 222 is an edge extending between said two side walls 11, 12, the edge being arranged to allow for example a hook-shaped end portion 921 of the second screening element 92 to be connected thereto. The second screen connector 22 is arranged above the first screen connector 21, such that the pivotable element 212 of the first screen connector 21 may pivot between two extreme positions defined by the blocking ledge 216 on one side, and a lower portion 223 of the fixed beam 221 of the second screen connector 22 on the other side.

Figure 3B:
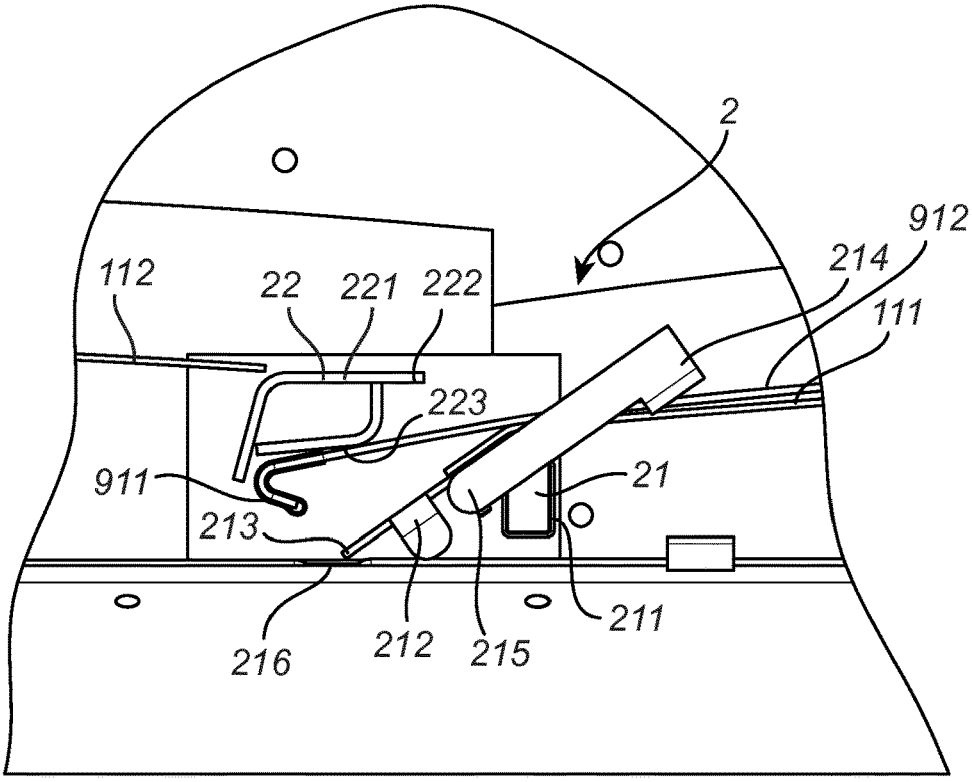
FIG. 3B is a side view of the screen holder arrangement of FIG. 3A, wherein the pivotable element of the first screen connector is in the first position and a first screening element is inserted into the screen holder arrangement.

FIG. 3B is a side view of the screen holder arrangement 1 of FIG. 3A, wherein the pivotable element 212 of the first screen connector 21 is in the first position and a first screening element 91 is inserted into the screen holder arrangement 1. Here, the first screening element 91 has been inserted into the screening arrangement 1 by means of sliding on the first guiding ledges 111 of the two side walls 11, 12. The first screening element 91 comprises a screening mesh 912, and a hook-shaped end portion 911 for connecting the first screening element 91 to the pivotable element 212. In FIG. 3B, the first screening element 91 has been inserted to a point such that the hook-shaped end portion 911 has moved beyond the connection portion 213 of the pivotable element 212, thus allowing the pivotable element 212 to move to its second position before retracting the first screening element 91, thus connecting the hook-shaped end portion 911 to the connection portion 213 of the pivotable element 212.

Figure 3C:
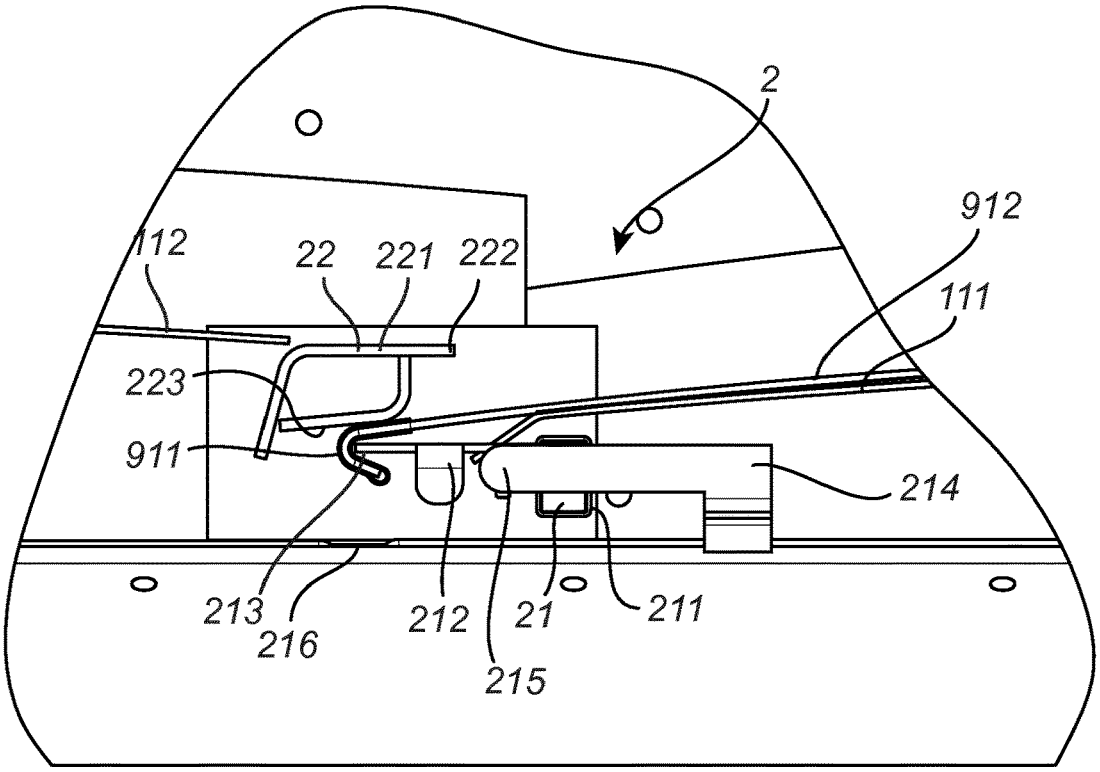
FIG. 3C is a side view of the screen holder arrangement of FIG. 3A, wherein the pivotable element of the first screen connector is in the second position and a first screening element is connected thereto.

FIG. 3C is a side view of the screen holder arrangement 2 of FIG. 3A, wherein the pivotable element 212 of the first screen connector 21 is in the second position and a first screening element 91 is connected thereto.

As shown herein, the pivotable element 212 has been moved to the second position and the first screening element 91 has been connected thereto. Thus, a seal has been formed between the first and second screen connectors 21, 22. This seal is formed by the hook-shaped end portion 911 of the first screening element 91 abutting the pivotable element 212 of the first screen connector 21 and a lower portion 223 of the fixed beam 221 of the second screen connector 22.

As seen in FIGS. 3A-D, the pivotable element 212 is arranged to pivot about an axis that is vertically offset the plane in which the first screening element 91 is arranged to slide into position in. Specifically, the pivotable element 212 is arranged to pivot about an axis that is located below the plane in which the first screening element 91 is arranged to move. Furthermore, the pivotable element 212 is arranged such that tension from the first screening element 91, when connected to the pivotable element 212, causes the pivotable element 212 to be biased towards pivoting in a locking direction. In other words, the connection of the first screening element 91 to the pivotable element 212 further increases the strength of the seal between the first screen connector 21 and the second screen connector 22.

Figure 3D:
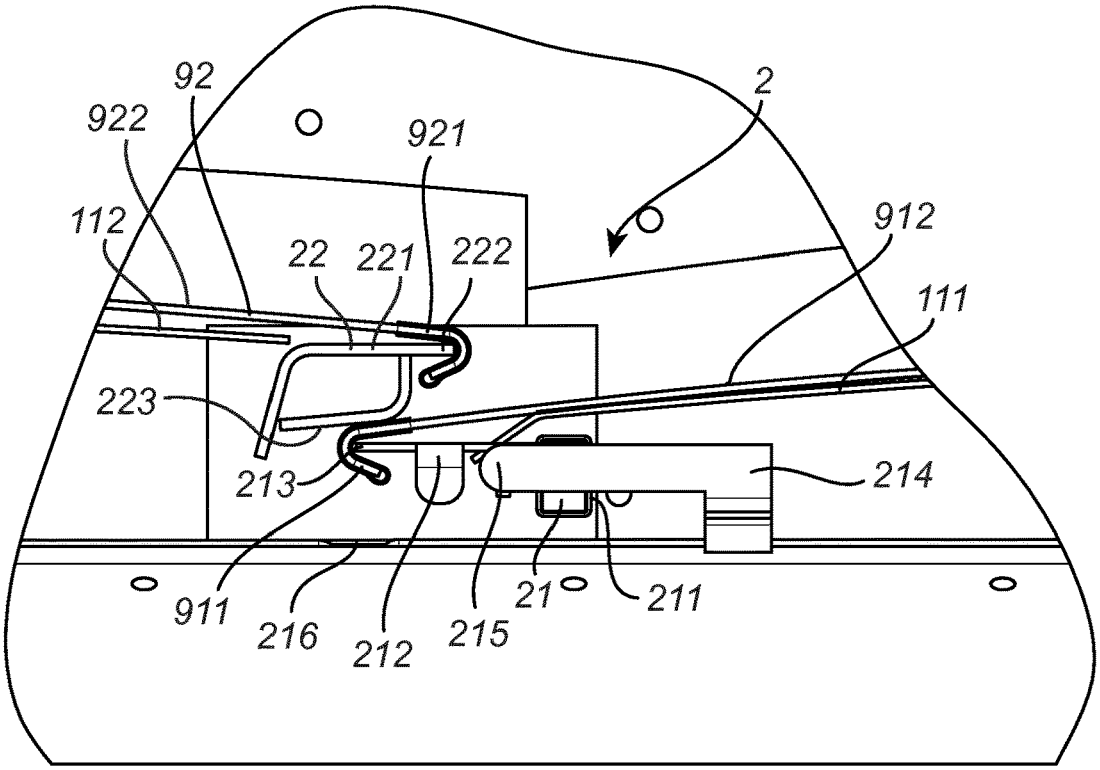
FIG. 3D is a side view of the screen holder arrangement of FIG. 3A, wherein the pivotable element of the first screen connector is in the second position and a first screening element is connected thereto, and wherein a second screening element is connected to the second screen connector.

FIG. 3D is a side view of the screen holder arrangement 2 of FIG. 3A, wherein the pivotable element 212 of the first screen connector 21 is in the second position and a first screening element 91 is connected thereto, and wherein a hook-shaped end portion 921 of the second screening element 92 is connected to the second screen connector 22. The second screening element 92 comprises a screen mesh 922 for screening a material held thereon. As is seen herein, there is little risk for material spillage between the second screening element 92 and the first screening element 91, as the first and second connectors 21, 22 are sealed against each other by means of the first end 911 of the first screening element 91. Thus, a screening device 100 with little risk of material spillage between the first screening element 91 and the second screening element 92 is provided.

Figure 4:
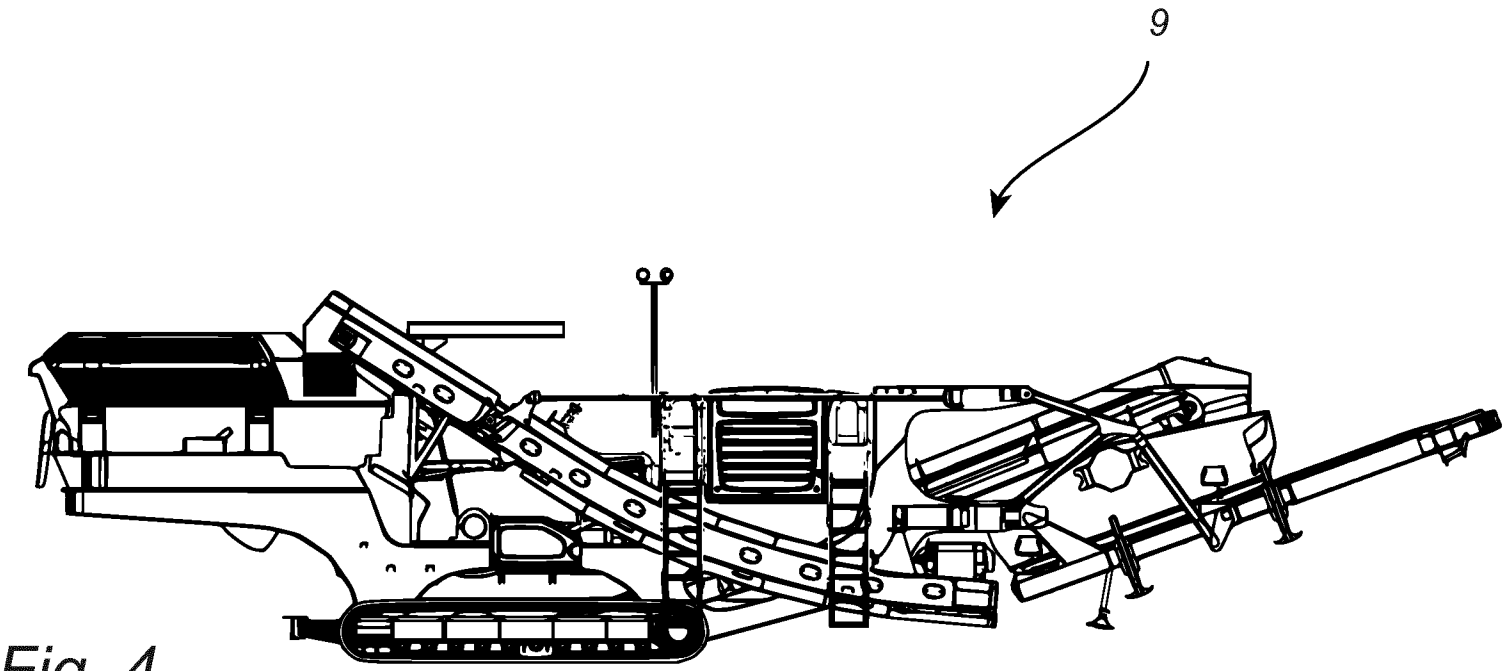
FIG. 4 is a side view of a mobile crushing and screening plant.

FIG. 4 is a side view of a mobile crushing and screening plant 9 with which the screening arrangement 1 of FIG. 1 may be used. The screening arrangement 1 may alternatively be used with other types of screening plants 9 than the one shown in FIG. 4.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. Furthermore, any reference signs in the claims should not be construed as limiting the scope.

The invention claimed is:

1. A screening arrangement including two side walls, each having an inward facing side and an outward facing side, and a screen holder arrangement extending between said inward facing sides of said two side walls for use in connecting a first and a second screening element, said screen holder arrangement comprising:

a first screen connector and a second screen connector, wherein said first screen connector comprises a pivotable element arranged to pivot about an axis that is parallel with a longitudinal extension of said first screen connector, wherein said pivotable element comprises a connection portion arranged to hold one end of said first screening element, and said pivotable element is arranged to pivot between a first position and a second position, respectively, wherein said pivotable element is arranged such that when it is in said second position and said first screening element is connected to said pivotable element, particles larger than a predetermined size are prevented from passing between said first and second screen connectors, and wherein a seal is formed between said first and second screen connectors when said pivotable element is in said second position and said first screening element is connected to said pivotable element.

2. The screening arrangement according to claim 1, wherein said seal is formed by means of connection between said first screen connector, said second screen connector, and a portion of said first screening element.

3. The screening arrangement according to claim 1, wherein said first screen connector further comprises an actuator connected to said pivotable element, wherein said actuator is arranged to control the pivot of said pivotable element.

4. The screening arrangement according to claim 3, wherein said actuator comprises a handle arranged on said outward facing side of one of said two side walls, said handle being connected, through said side wall, to said pivotable element.

5. The screening arrangement according to claim 4, wherein said actuator further comprises a sealing element for sealing said inwards facing side of said side wall from said outwards facing side of said side wall.

6. The screening arrangement according to claim 1, wherein said pivotable element is arranged to pivot in an opening direction and a locking direction, between said first position and said second position, respectively.

7. The screening arrangement according to claim 6, wherein said pivotable element is arranged such that when in said second position and with said first screening element connected thereto, said pivotable element is biased against pivoting in said opening direction by tension from said first screening element.

8. The screening arrangement according to claim 1, wherein said second screen connector comprises a fixed beam having a connection portion arranged to hold one end of said second screening element.

9. The screening arrangement according to claim 1, wherein each one of said two side walls comprises a respective first guiding ledge for guiding said first screening element towards said connection portion of said pivotable element.

10. The screening arrangement according to claim 9, wherein said actuator further comprises a sealing element for sealing said inwards facing side of said side wall from said outwards facing side of said side wall, and wherein said first guiding ledge of at least one side wall extends above a portion of said side wall through which said handle is connected to said pivotable element.

11. The screening arrangement according to claim 9, wherein said pivotable element is arranged to pivot in an opening direction and a locking direction, between said first position and said second position, respectively, and wherein said first guiding ledge of at least one side wall extends above a portion of said side wall through which said handle is connected to said pivotable element.

12. The screening arrangement according to claim 1, wherein each one of said two side walls comprises a second guiding ledge for guiding said second screening element towards a connection portion of said second screen connector.

13. The screening device comprising a screening arrangement according to claim 1, and a first and a second screening element connected thereto.

14. A method for connecting a screening element to a screening arrangement, wherein said method comprises the steps of:

providing a screening arrangement according to claim 1, providing a first screening element and a second screening element, said first and second screening elements each having a connection portion located at one end of said respective screening element, moving said pivotable element to said first position, inserting said first screening element into a position such that said connection portion of said first screening element is moved past said pivoting element, moving said pivotable element to said second position, withdrawing said first screening element such that said connection portion of said first screening element comes into contact with said connection portion of said pivotable element, thus connecting said first screening element to said first screen connector, connecting said connection portion of said second screening element to said second screen connector.

15. A mobile material processing plant comprising a screening arrangement according to claim 1.

* * * * *